US007728776B2

(12) United States Patent
Lin et al.

(10) Patent No.: US 7,728,776 B2
(45) Date of Patent: Jun. 1, 2010

(54) DUAL-BAND ANTENNA

(75) Inventors: Ching-Chi Lin, Taipei Hsien (TW); Jia-Hung Su, Taipei Hsien (TW); Kai Shih, Taipei Hsien (TW); Yu-Yuan Wu, Taipei Hsien (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 188 days.

(21) Appl. No.: 11/858,520

(22) Filed: Sep. 20, 2007

(65) Prior Publication Data

US 2009/0079643 A1 Mar. 26, 2009

(51) Int. Cl.
*H01Q 1/24* (2006.01)

(52) U.S. Cl. ..... 343/702; 343/745

(58) Field of Classification Search ..... 343/702, 343/745

See application file for complete search history.

(56) References Cited

U.S. PATENT DOCUMENTS

2005/0259024 A1* 11/2005 Hung et al. ..... 343/770
2006/0187121 A1* 8/2006 Chang et al. ..... 343/7 MS
2007/0241976 A1* 10/2007 Montgomery et al. ..... 343/745
2008/0150829 A1* 6/2008 Lin et al. ..... 343/860

* cited by examiner

*Primary Examiner*—Douglas W Owens
*Assistant Examiner*—Kyana R Robinson
(74) *Attorney, Agent, or Firm*—WPAT, P.C.; Anthony King

(57) ABSTRACT

A dual-band antenna has a first meandering portion, a second meandering portion and a connection portion defining two ends. The first meandering portion and the second meandering portion have different length. One end of the first meandering portion connects one end of the second meandering portion. The other end of the first meandering portion connects one end of the connection portion. The other end of the second meandering portion connects a feeding portion. The other end of the connection portion connects a ground portion. The feeding portion, the second meandering portion, the first meandering portion and the connection portion obtain an electrical resonance corresponding to a first frequency range. The second meandering portion obtains an electrical resonance corresponding to a second frequency range.

10 Claims, 3 Drawing Sheets

DUAL-BAND ANTENNA

BACKGROUND OF THE INVENTION

1. Field of the Invention

The invention relates to the field of antenna. More specifically, a dual-band antenna operates at wireless local area network.

2. The Related Art

According to the progress of the communication technology, the key development is the transfer from wired to wireless communication. A plurality of different wireless communication bands may be used by devices such as laptops. For example, the standards for wireless local area network (LAN) include the IEEE 802.11a band and the IEEE 802.11b/g.

In recent years, Wireless Local Area Network (WLAN) mobile communication products under IEEE 802.11a/b/g standards, such as WLAN cards for computers are gaining popularity in wireless communication market. Wherein, IEEE 802.11b/g standard is suitable for working at 2.4 GHz frequency band covering 2.412 GHz to 2.462 GHz, while IEEE 802.11a standard is suitable for working at 5 GHz frequency band covering 4.9 GHz to 5.87 GHz. Many WLAN mobile communication products want to be used under both IEEE 802.11a and IEEE 802.11b/g standard.

The data rate of the IEEE 802.11a/g standard is 54 Mbps which is high enough to transmit various data such as image data, video data and audio data. If the laptop would have wireless communication function using IEEE 802.11a and IEEE 802.11b/g standards over 54 Mbps, the antennas is necessary for operating at 2.4 GHz and 5.2 GHz bands.

A conventional dual-band antenna is disclosed in U.S. Pat. No. 7,196,668. The dual band antenna has a first antenna, an antenna array and a wireless module, which is configured in the laptops. The antenna array has a plurality of second antennas and a plurality of connectors connected to the second antennas. The distance between two adjacent second antennas is identical. The first antenna and the second antennas respectively operate at 2.4 GHz band and 5.2 GHz band.

The dual band antenna has the large dimension according to the distance between two adjacent second antennas being identical. It is necessary to retain a large space in the laptops for configuring the dual-band antenna in the laptops. The process for configuring the dual-band antenna in the laptop is complex because the distance between two adjacent second antennas is identical.

SUMMARY OF THE INVENTION

An object of the present invention is to provide a dual-band antenna having a first meandering portion, a second meandering portion, a connecting portion, a feeding portion and a ground portion. The first meandering portion, the second meandering portion and the connection portion define two ends. One end of the first meandering portion connects one end of the second meandering portion.

The other end of the first meandering portion connects one end of the connection portion. The other end of the connection portion connects the ground portion. The other end of the second meandering portion connects the feeding portion. The length of the first meandering portion is shorter than the length of the second meandering portion.

When the dual-band antenna operates at wireless communication, the feeding portion, the second meandering portion, the first meandering portion and the connection portion obtain an electrical resonance corresponding to a first frequency range. The second meandering portion obtains an electrical resonance corresponding to a second frequency range.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENT

Structures of a dual-band antenna described herein are sized and shaped to tune the dual-band antenna for operation in wireless telecommunication bands. In an embodiment of the invention described in detail below, the dual-band antenna has structure which is primarily associated with operating bands covering 2.4 GHz band and 5.2 GHz band.

Figure 1:
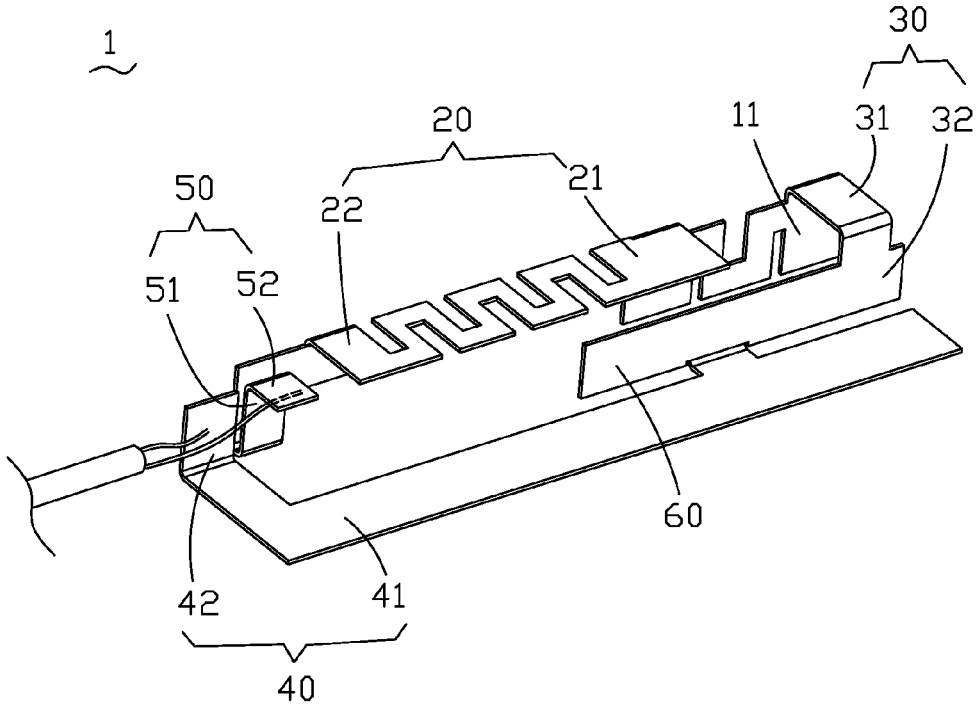
FIG. 1 shows a front view of a dual-band antenna according to the present invention.
Figure 2:
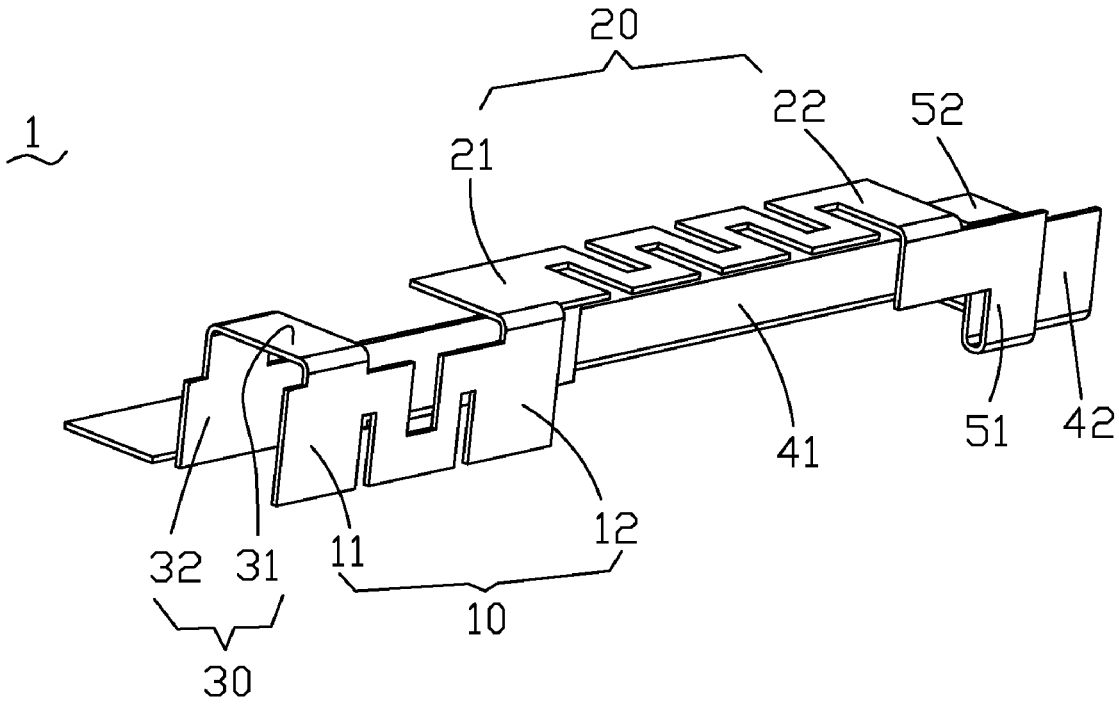
FIG. 2 shows a rear view of the dual-band antenna according to the present invention.

Please refer to FIG. 1 and FIG. 2. A preferred embodiment of the dual-band antenna 1 according to the present invention is shown. The dual-band antenna 1 has a first meandering portion 10, a second meandering portion 20, a connection portion 30, a ground portion 40 and a feeding portion 50. The first meandering portion 10 defines a first end 11 and a second end 12 opposite to the first end 11. The second meandering portion 20 defines a third end 21 and a fourth end 22.

In this case, the first meandering portion 10 is perpendicular to the second meandering portion 20. The length of the first meandering portion 10 is shorter than the length of the second meandering portion 20. The first end 11 of the first meandering portion 10 connects the connection portion 30 and the second end 12 of the first meandering portion 10 connects the third end 21 of the second meandering portion 20. The fourth end 22 of the second meandering portion 20 connects the feeding portion 50.

In this case, the feeding portion 50 has a first section 51 and a second section 52. One end of the first section 51 connects the fourth end 22 of the second meandering portion 20, and the other end of the first section 51 connects the second section 52. The first section 51 of the feeding portion is perpendicular to the second meandering portion 20 and the second section 52. In this case, the first section is formed as an U-shape.

One surface of the first section 51 and the first meandering portion 10 are at the same plane. The second section 52 of the feeding portion 50 is parallel to the second meandering portion 20. In this case, the second section 52 of the feeding portion 50 connects a signal lead of a feeding cable. The connection portion 30 has a third section 31 and a fourth section 32. One end of the third section 31 connects one end of the fourth section 32. The other end of the third section 31 connects the first end 11 of the first meandering portion 10, and the other end of the fourth section 32 connects the ground portion 40.

In this case, the third section 31 of the connection portion 30 is perpendicular to the first meandering portion 10. The third section 31 of the connection 30 and the second meandering portion 20 are at the same plane. The fourth section 32 is perpendicular to the third section 31, and faces the first meandering portion 10.

The ground portion 40 has a fifth section 41 and a sixth section 42. The fifth section 41 is perpendicular to the fourth section 32 of the connection portion 30. The sixth section 42 is perpendicular to the fifth portion 41, and close to the feeding portion 50. The sixth section 42 connects a ground lead of the feeding cable.

In this case, the fifth portion 41 of the ground portion 40 is formed as a L-shape. The ground portion 41 may electronically couple with a metal shield of an electrical device (not shown in figures) when the dual-band antenna 1 is configured in the electrical device. The dual-band antenna 1 further has a tunable portion 60. In this case, the tunable portion 60 connects the fourth section 32 of the connection portion 30 and the fifth section 41 of the ground portion 40. The tunable portion 60 and the fourth section 32 of the connection portion 30 are at the same plane.

The dual-band antenna 1 is a loop type antenna. The first meandering portion 10, the second meandering portion 20, the connection portion 30 and the feeding portion 50 obtain an electrical resonance corresponding to a half wavelength corresponding to a first frequency range covering 2.4 GHz. The second meandering portion 20 also obtains an electrical resonance corresponding to a quarter wavelength corresponding to a second frequency range covering 5.2 GHz.

The size, the width and the length of the first meandering portion 10 and the second meandering portion 20 have a most pronounced effect on antenna characteristics in the first frequency range. Furthermore, the size, the width and the length of the second meandering portion 20 have a most pronounced effect on antenna characteristics in the second frequency range. The size, the width and the length of the tunable portion 60 have minor pronounced effect in the first frequency band.

Figure 3:
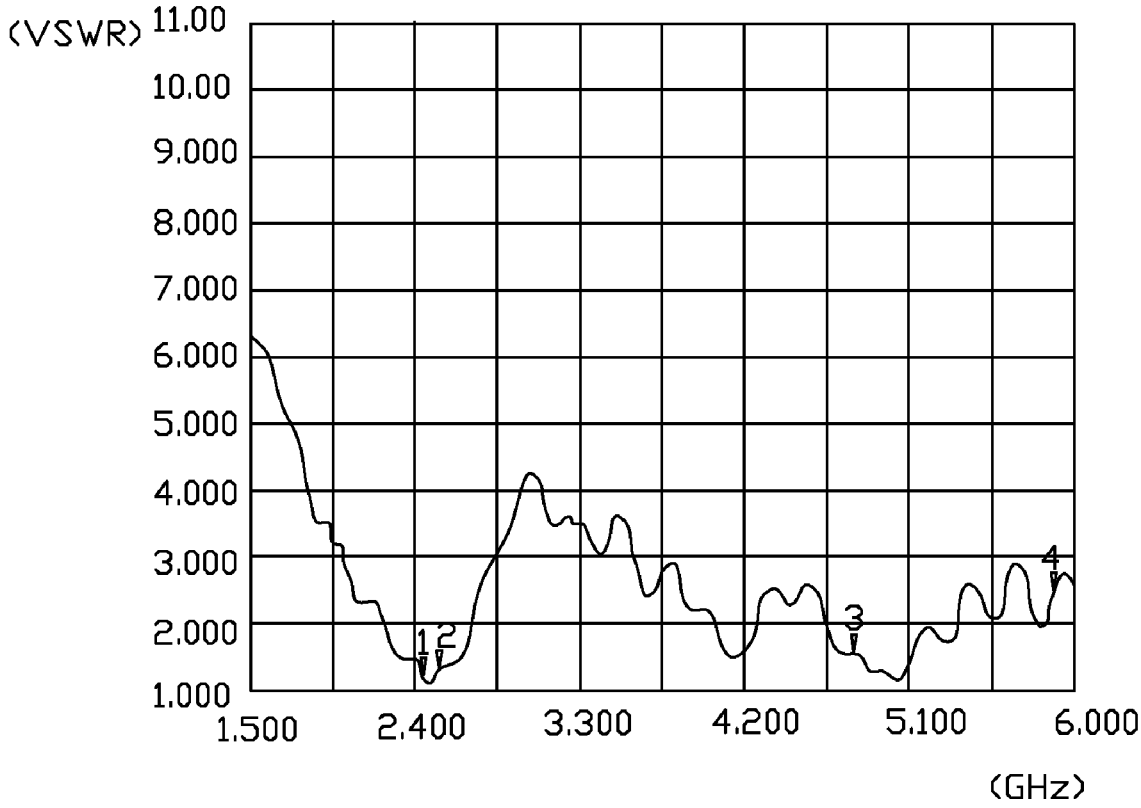
FIG. 3 shows a Voltage Standing Wave Ratio (VSWR) test chart of the dual-band antenna.

Please refer to FIG. 3, which shows a Voltage Standing Wave Ratio (VSWR) test chart of the dual-band antenna 1 when the dual-band antenna 1 operates at wireless communication. When the dual-band antenna 1 operates at first frequency range covering 2.412 GHz (indicator 1 in FIG. 3) and 2.462 Gz (indicator 2 in FIG. 3), the VSWR value is below 3. When the dual-band antenna 1 operates at second frequency range covering 4.9 GHz (indicator 3 in FIG. 3) and 5.875 GHz (indicator 4 in FIG. 3), the VSWR value is also below 3.

Therefore, the dual-band antenna 1 obtains the first frequency range covering 2.4 GHz corresponding to operation frequency of the IEEE 802.11b/g standard. The dual-band antenna 1 also obtains the second frequency range covering 5.2 GHz corresponding to operation frequency of the IEEE 802.11a standard. Because the dual-band antenna 1 is the loop type antenna which has a simple structure, the process for configuring the dual-band antenna 1 in the electrical device is easy.

Furthermore, the present invention is not limited to the embodiments described above; various additions, alterations and the like may be made within the scope of the present invention by a person skilled in the art. For example, respective embodiments may be appropriately combined.

What is claimed is:

1. A dual-band antenna, comprising:

a ground portion;

a first meandering portion defining a first end and a second end;

a second meandering portion perpendicular to said first meandering portion and defining a third end and a fourth end, said third end connected to said second end of said first meandering portion, the length of said first meandering portion being shorter than the length of said second meandering portion;

a connection portion connected to said ground portion and said first end of said first meandering portion; and a feeding portion connected to said fourth end of said second meandering portion and having a first section and a second section, said first section connecting said fourth end of said second meandering portion wherein said first meandering portion is perpendicular to said second meandering portion, and said second section is parallel to said second meandering portion; wherein said connection portion interconnects the ground portion and the first meandering portion, said first meandering portion interconnects said connection portion and said second meandering portion, said second meandering portion interconnects said first meandering portion and said feeding portion.

2. The dual-band antenna as claimed in claim 1, wherein said first section of said feeding portion is formed as an U-shape.

3. The dual-band antenna as claimed in claim 1, wherein said connection portion has a third section connected to said first meandering portion, and a fourth section connected to said ground portion, said third section is perpendicular to said first meandering portion, said fourth section is perpendicular to said third portion and said ground portion, said fourth section is arranged to face to said first meandering portion.

4. The dual-band antenna as claimed in claim 3, wherein said third section is parallel to said second meandering portion, said fourth section is arranged to face to said first meandering portion.

5. The dual-band antenna as claimed in claim 1, wherein said ground portion has a fifth section and a sixth section, said fifth section connects said fourth section of said connection portion, said sixth section is perpendicular to said fifth section and arranged close to said feeding portion for connecting a ground lead of a feeding cable.

6. The dual-band antenna as claimed in claim 1, further comprising a tunable portion connected to said ground portion and said connection portion.

7. The dual-band antenna as claimed in claim 6, wherein said tunable portion and said fourth section of said connection portion are at the same plane.

8. A dual-band antenna, comprising:

a ground portion;

a first meandering portion;

a second meandering portion connected to said first meandering portion, the length of said first meandering portion being shorter than the length of said second meandering portion, said first meandering portion and said second meandering portion arranged at different planes;

a connection portion connected to said first meandering portion and said ground portion; and a feeding portion connected to said second meandering portion; wherein said connection portion interconnects the ground portion and the first meandering portion, said first meandering portion interconnects said connection portion and said second meandering portion, said second meandering portion interconnects said first meandering portion and said feeding portion; wherein said connection portion, said first meandering portion, said second meandering portion and said feeding portion are in order and serially connected; wherein the amounted length of said feeding portion, said second meandering portion, said first meandering portion and said connection portion has a maximum effect on antenna characteristics in a first frequency range, the length of said second meandering portion has a maximum effect on antenna characteristics in a second frequency range.

9. The dual-band antenna as claimed in claim 8, wherein said dual-band antenna is a loop type antenna.

10. The dual-band antenna as claimed in claim 8, further comprising a tunable portion connected to said connection portion and said ground portion, said tunable portion having a minor pronounced effect on antenna characteristics in said first second frequency range.

* * * * *